US006709247B1

(12) United States Patent
Clendenin et al.

(10) Patent No.: US 6,709,247 B1
(45) Date of Patent: Mar. 23, 2004

(54) SCROLL COMPRESSOR HAVING A DEFLECTABLE BEARING HOUSING FOR SHAFT ALIGNMENT

(75) Inventors: Harry B. Clendenin, Sidney, OH (US); Keith J. Reinhart, Sidney, OH (US); Wei Hain Sun, West Chester, OH (US); Troy R. Brostrom, Lima, OH (US); Macinissa Mezache, Troy, OH (US); Tom R. Hodapp, Centerville, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 10/321,236

(22) Filed: Dec. 16, 2002

(51) Int. Cl.[7] ..... F01C 1/04; F01C 21/02; F04B 35/00; F16C 27/00

(52) U.S. Cl. ..... 418/55.1; 417/902; 384/215; 384/222

(58) Field of Search ..... 418/55.1; 417/902; 384/215, 220, 222

(56) References Cited

U.S. PATENT DOCUMENTS 2,159,545 A * 5/1939 Bartosch ..... 384/215
2,515,799 A * 7/1950 Rouy ..... 384/222
5,411,384 A * 5/1995 Bass et al. ..... 418/55.1

FOREIGN PATENT DOCUMENTS

JP 3-96678 * 4/1991 ..... 418/55.1

* cited by examiner

*Primary Examiner*—John J. Vrablik
(74) *Attorney, Agent, or Firm*—Harness, Dickey & Pierce, P.L.C.

(57) ABSTRACT

A compressor is driven by a drive shaft rotatably supported by a main bearing housing and a lower bearing housing. The main bearing housing positions a main bearing at or near a nodal point of the drive shaft during vibration by the drive shaft. The main bearing housing is designed such that the main bearing pivots during the vibration of the drive shaft in order to maintain surface contact between the bearing and the drive shaft to eliminate edge loading of the bearing.

24 Claims, 4 Drawing Sheets

SCROLL COMPRESSOR HAVING A DEFLECTABLE BEARING HOUSING FOR SHAFT ALIGNMENT

FIELD OF THE INVENTION

The present invention relates to scroll machines. More particularly, the present invention relates to a scroll compressor which has a main bearing housing with an elastic center which is designed to coincide with the drive shaft's nodal point corresponding to the first mode of vibration of the drive shaft.

BACKGROUND AND SUMMARY OF THE INVENTION

A class of machines exists in the art generally known as scroll machines which are used for the displacement of various types of fluid. The scroll machines can be configured as an expander, a displacement engine, a pump, a compressor etc. and the features of the present invention are applicable to any one of these machines. For purposes of illustration, however, the disclosed embodiment is in the form of a hermetic refrigerant scroll compressor.

Scroll compressors are becoming more and more popular for use as compressors in both refrigeration as well as air conditioning applications due primarily to their capability for extremely efficient operation. Generally, these machines incorporate a pair of intermeshed spiral wraps, one of which is caused to orbit relative to the other so as to define one or more moving chambers which progressively decrease in size as they travel from an outer suction port toward a center discharge port. An electric motor is provided which operates to drive the orbiting scroll member via a suitable drive shaft affixed to the motor rotor. In a hermetic compressor, the bottom of the hermetic shell normally contains an oil sump for lubricating and cooling purposes.

The electric motor typically includes a motor stator which is press fit into a shell of the compressor. The drive shaft is typically press fit to the motor rotor and it is rotatably secured by a main bearing housing and a lower bearing housing. Each bearing housing is also secured to the shell of the compressor. During compressor operation, the drive shaft undergoes a nominal static deflection due to the net force on the drive shaft, and as a resultant dynamic load from various excitation sources. The inventors of the present invention have found that a major contribution to the sound levels of the operating compressor in the lower frequency bands is due to the vibration of the drive shaft.

The behavior of the drive shaft exhibits a nodal point (zero transverse displacement) in the vicinity of the main bearing of the main bearing housing. The kinetics of the drive shaft with respect to the main bearing of the main bearing housing suggest that the stress in the main bearing will be excessive, primarily because of the localized edge loading from the drive shaft. The localized edge loading is due in part to the rigidity of the main bearing housing which supports the main bearing. This excessive stress being induced in the main bearing due to edge loading can lead to excessive wear of the main bearing and eventually the bearing will wear out prematurely thus reducing the operational life of the compressor. In addition, the dynamic part of this load can be transmitted to the shell of the compressor and causes it to generate noise.

The present invention provides the art with a unique main bearing housing which is designed to locate the loaded drive shafts nodal point at the elastic center of the main bearing to eliminate edge loading and its associated problems. The main bearing housing of the present invention is designed to be compliant in the area supporting the main bearing which will locate the nodal point of the drive shaft closer to the elastic center of the main bearing. The compliancy in the mounting of the main bearing by the main bearing housing improves the drive shaft to main bearing contact distribution and further aids in the elimination of edge loading.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 6 is a graph illustrating the kinematics of the drive shaft with respect to the main bearing housing in both a typical construction and an ideal construction.

DETAILED DESCRIPTION OF THE PREFERRED EMBODIMENTS

Figure 1:
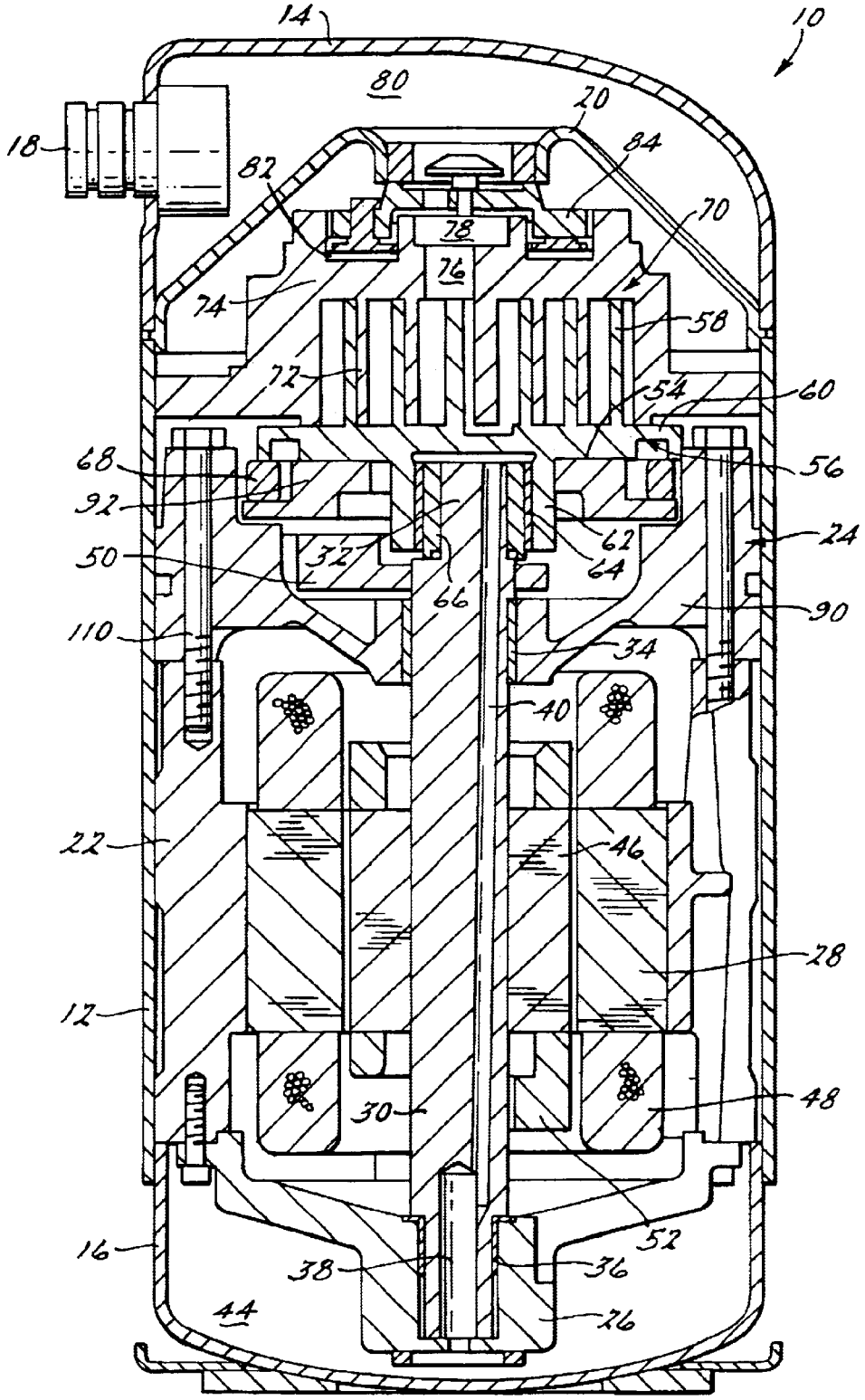
FIG. 1 is a vertical cross section of a hermetic scroll compressor incorporating the unique main bearing housing in accordance with the present invention.

Referring now to the drawings in which like reference numerals designate like or corresponding parts throughout the several views, there is shown in FIG. 1 a scroll compressor incorporating the unique main bearing housing in accordance with the present invention and which is indicated generally by the reference numeral 10. Scroll compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein. A transversely extending partition 20 is affixed to shell 12 by being welded about its periphery at the same point that cap 14 is welded to shell 12. A compressor mounting frame 22 is press fit within shell 12 and is supported by the end of base 16. Base 16 is slightly smaller in diameter than shell 12 such that base 16 is received within shell 12 and welded about its periphery as shown in FIG. 1.

Major elements of compressor 10 that are affixed to frame 22 include a two-piece main bearing housing assembly 24, a lower bearing housing 26 and a motor stator 28. A drive shaft or crankshaft 30 having an eccentric crank pin 32 at the upper end thereof is rotatably journaled in a bearing 34 secured within main bearing housing assembly 24 and a second bearing 36 secured within lower bearing housing 26. Crankshaft 30 has at the lower end thereof a relatively large diameter concentric bore 38 which communicates with a radially outwardly positioned smaller diameter bore 40 extending upwardly therefrom to the top of crankshaft 30. The lower portion of the interior of shell 12 defines an oil sump 44 which is filled with lubricating oil to a level slightly above the lower end of a rotor 46, and bore 38 acts as a pump to pump lubricating fluid up crankshaft 30 and into bore 40 and ultimately to all of the various portions of compressor 10 which require lubrication.

Crankshaft 30 is rotatably driven by an electric motor which includes stator 28, winding 48 passing therethrough and rotor 46 press fitted on crankshaft 30. An upper counterweight 50 is secured to crankshaft 30 and a lower counterweight 52 is secured to rotor 46.

The upper surface of two-piece main bearing housing assembly 24 is provided with a flat thrust bearing surface 54 on which is disposed an orbiting scroll member 56 having the usual spiral vane or wrap 58 extending upward from an end plate 60. Projecting downwardly from the lower surface of end plate 60 of orbiting scroll member 56 is a cylindrical hub 62 having a journal bearing 64 therein and in which is rotatively disposed a drive bushing 66 having an inner bore in which crank pin 32 is drivingly disposed. Crank pin 32 has a flat on one surface which drivingly engages a flat surface formed in a portion of the inner bore of drive bushing 66 to provide a radially compliant driving arrangement, such as shown in assignee's U.S. Letters Pat. No. 4,877,382, the disclosure of which is hereby incorporated herein by reference. An Oldham coupling 68 is also provided positioned between orbiting scroll member 56 and two-piece bearing housing assembly 24. Oldham coupling 68 is keyed to orbiting scroll member 56 and to a non-orbiting scroll member 70 to prevent rotational movement of orbiting scroll member 56.

Non-orbiting scroll member 70 is also provided with a wrap 72 extending downwardly from an end plate 74 which is positioned in meshing engagement with wrap 58 of orbiting scroll member 56. Non-orbiting scroll member 70 has a centrally disposed discharge passage 76 which communicates with an upwardly open recess 78 which is in turn is in fluid communication with a discharge muffler chamber 80 defined by cap 14 and partition 20. An annular recess 82 is also formed in non-orbiting scroll member 70 within which is disposed a floating seal assembly 84.

Recesses 78 and 82 and floating seal assembly 84 cooperate to define axial pressure biasing chambers which receive pressurized fluid being compressed by wraps 58 and 72 so as to exert an axial biasing force on non-orbiting scroll member 70 to thereby urge the tips of respective wraps 58 and 72 into sealing engagement with the opposed end plate surfaces of end plates 74 and 60, respectively. Floating seal assembly 84 is preferably of the type described in greater detail in assignee's U.S. Pat. No. 5,156,539, the disclosure of which is hereby incorporated herein by reference. Non-orbiting scroll member 70 is designed to be mounted for limited axial movement to two-piece main bearing housing 24 in a suitable manner such as disclosed in the aforementioned U.S. Pat. No. 4,877,382 or assignee's U.S. Pat. No. 5,102,316, the disclosure of which is hereby incorporated herein by reference.

The present invention is directed to the unique design for main bearing housing assembly 24. Main bearing housing assembly 24 comprises a main bearing housing 90 and a thrust plate 92. Thrust plate 92 is secured to main bearing housing 90 using a plurality of bolts (not shown). Thrust plate 92 defines flat thrust bearing surface 54 on which is disposed orbiting scroll member 56 a flat surface 94 on which Oldham coupling 68 is supported.

Figure 2:
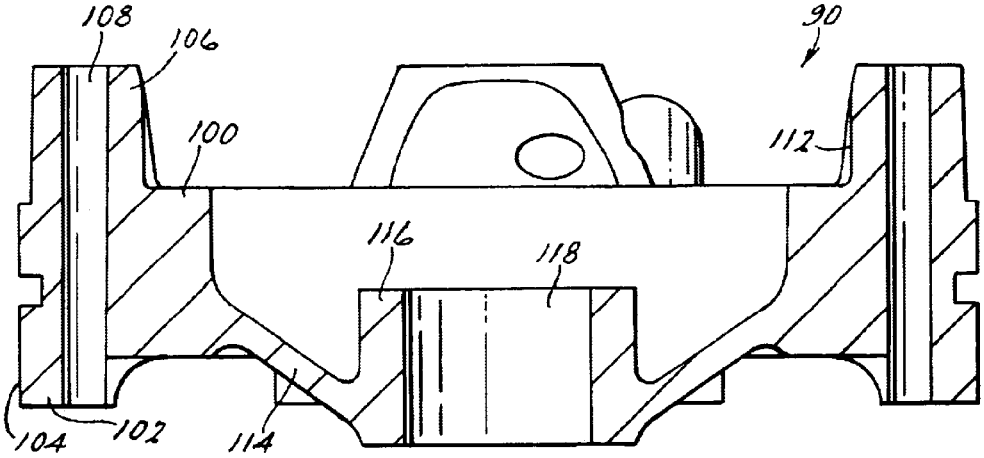
FIG. 2 is a vertical cross section of the main bearing housing shown in FIG. 1.
Figure 3:
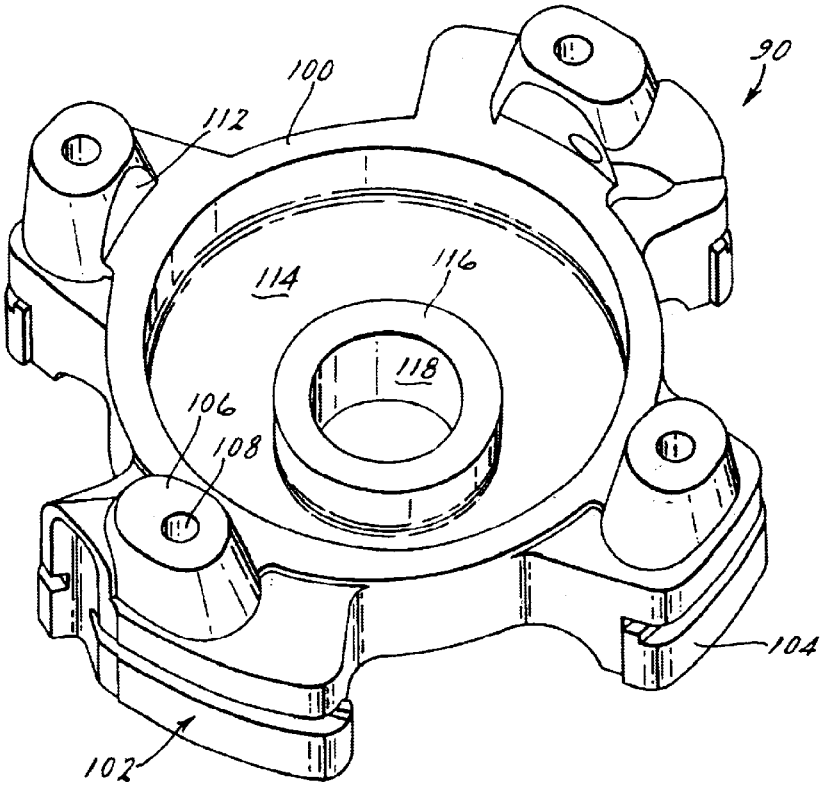
FIG. 3 is a top perspective view of the main bearing housing shown in FIG. 2.
Figure 4:
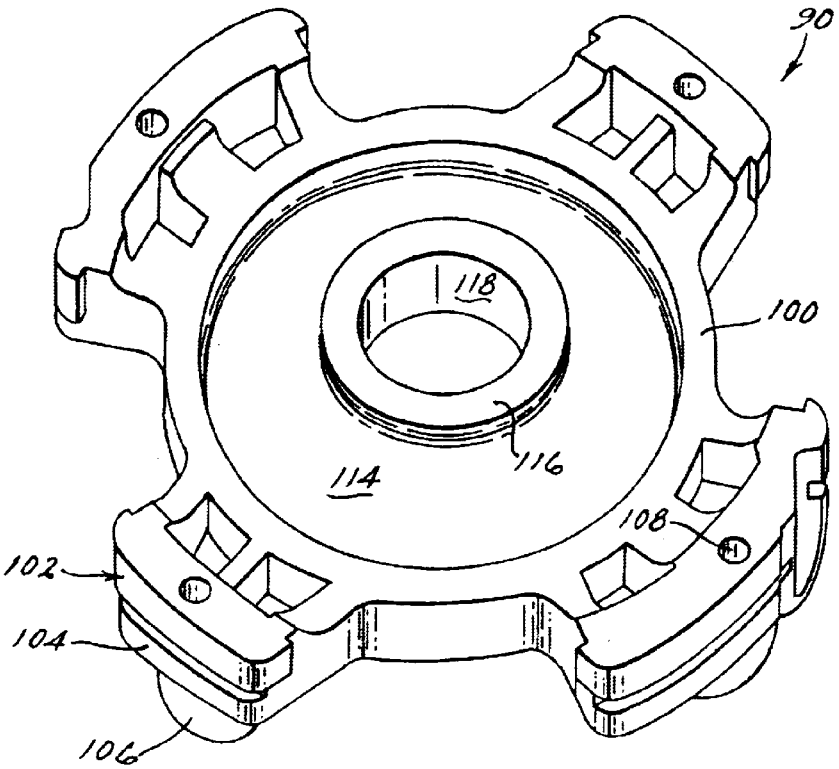
FIG. 4 is a bottom perspective view of the main bearing housing shown in FIG. 2.

Referring now to FIG. 2, main bearing housing 90 comprises a generally circular section 100 which supports thrust plate 92. A plurality of legs 102 (four in the embodiment shown) extend radially outward from circular section 100. In the embodiment illustrated, the outer surface 104 of each leg 102 defines an effective diameter that provides a clearance with shell 12. Each leg 102 includes an upstanding tower 106 through which extend a mounting hole 108. Mounting holes 108 are utilized to secure main bearing housing 90 to compressor mounting frame 22 using bolts 110 as shown in FIG. 1. In another embodiment of the present invention (not shown), the outer surface 104 of each leg 102 defines an effective diameter that is press fit into shell 12. In this embodiment, mounting hole 108 in each tower 106 is eliminated because main bearing housing 90 is attached to shell 12 and not directly attached to mounting frame 22. The inner surface 112 of each tower 106 is machined to radially support thrust plate 92.

Main bearing housing 90 further comprises a frusto-conical web 114 which is angled downwardly to support a cylindrical section 116. Frusto-conical web 114 extends from the lower end of circular section 100 to the lower end of cylindrical section 116. Cylindrical section 116 defines an inner bore 118 within which bearing 34 is press fitted. The design of main bearing housing 90 with frusto-conical web 114 and cylindrical section 116 provides compliancy of main bearing housing 90 to improve dynamic alignment of main bearing 34 and cylindrical section 116 and thereby improve the reliability of compressor 10 and reduces the transmission of the dynamic load from crankshaft 30 to shell 12. Main bearing housing 90 with frustoconical web 114 and cylindrical section 116 can be designed to position the loaded drive shaft nodal point at the elastic center of main bearing 34 if desired.

Drive shaft 30 is loaded at crank pin 32 which drivingly engages orbiting scroll 62 as well as being loaded by upper counterweight 50 and lower counterwieght 52. Main bearing 34 and lower bearing 36 provide points for reaction forces to these loads. This combination of forces bends drive shaft 30. The bent shape of drive shaft 30 corresponds to its instantaneous loading conditions. To describe the bending throughout the rotation of drive shaft 30, the bending can be seen as an average shape plus the dynamic variation of load with the position of crank pin 32. Thus, the main bearing journal of drive shaft 30 is not parallel to the axis of compressor 10 by some angle, and the direction of this angle varies with the rotation of drive shaft 30. It is a significant and separately motivated effort to achieve elastic matching of the primary curvature of the loaded drive shaft 30. By improving this matching, main bearing 34 and circular section 116 deflect into alignment with the bent main journal of drive shaft 30. An excessively stiff main bearing housing web 114 prevents main bearing 34 and cylindrical section 116 from deflecting into parallel alignment with the main journal of drive shaft 30 and thus yields top edge loading. An excessively soft main bearing housing web 114 allows main bearing 34 and cylindrical section 116 to deflect more than drive shaft 30 and thus yields bottom loading. Cylindrical section 116 should be designed to be stiff enough to act as a solid body to support main bearing 34. An excessively thin cylindrical section 116 allows the top portion of cylindrical section 116 to deflect away from the journal load and yields center loading with insufficient distribution of the load to the upper section of main bearing 34.

It is a second significant achievement to match the dynamic variation in the curvature of drive shaft 30 due to vibration so that edge loading does not break down the oil film to yield metal-to-metal contact and thereby prevent wear of main bearing 34. It is a third significant achievement to position main bearing 34 at the node of drive shaft 30 which minimized the transmission of the vibration of drive shaft 30 to main bearing housing 90 and the surrounding environment.

Figure 5:
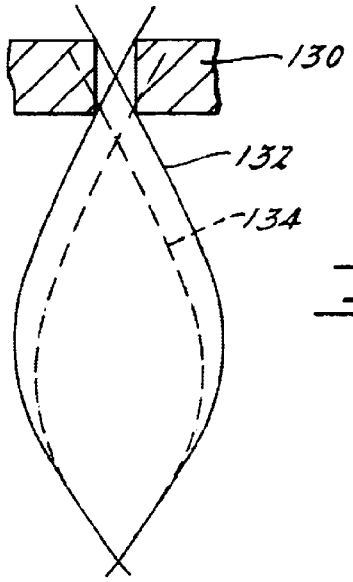
FIG. 5 is a graph which illustrates a typical sound spectrum produced by a prior art compressor.
Figure 5:
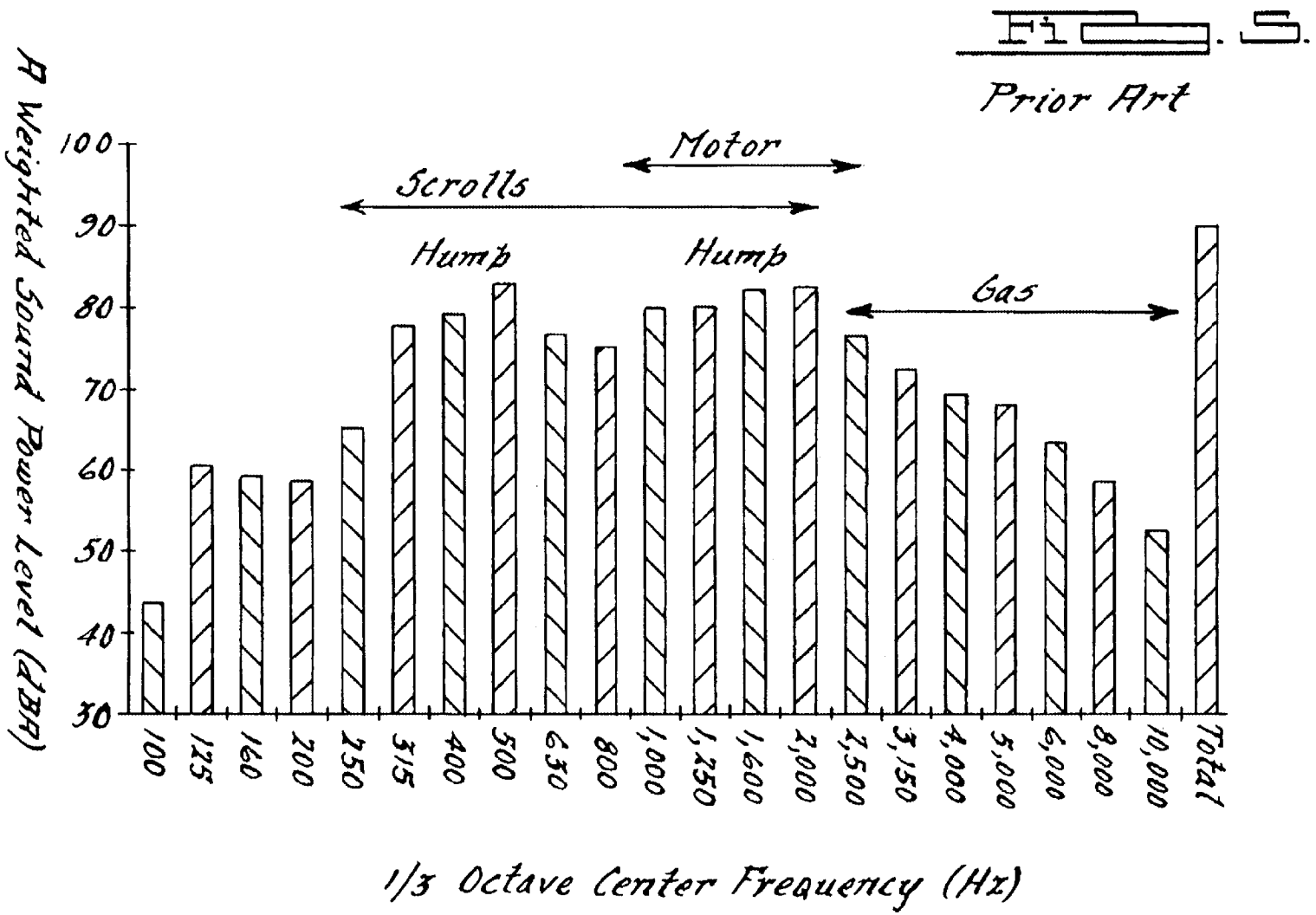
Fig. 5. Prior Art

The envelope of a sound spectrum produced by a prior art compressor has a unique and easily recognizable shape. The sound spectrum exhibits two "humps" whose location in the spectrum shifts slightly depending upon the compressor size. The inventors of the present invention have associated the groups of frequency bands in the sound spectrum with specific components of the compressor as shown in FIG. 5. The "hump" on the right side or upper half of the frequencies of the sound spectrum has been attributed to the top cap of the compressor which typically has its natural frequencies in that part of the frequency range. The excitation source is the discharge gas impinging upon the top cap. The "hump" on the left side or lower half of the frequencies is caused by a variety of circumstances and the inventors of the present invention have determined that a major contribution to the sound levels in these lower frequency bands is due to the vibration of the drive shaft.

Referring now to FIG. 6, the vibration behavior of the drive shaft in a prior art compressor exhibits a nodal point (zero transverse displacement) in the vicinity of a main bearing housing 130 as shown in the broken line of FIG. 6 in the absence of main bearing 34. Ideally, the nodal point is located at the elastic center of main bearing 34 as shown in the solid line 132 of FIG. 6. When the nodal point is not located at the elastic center of main bearing 34 (the broken line 134 of FIG. 6), the stress on the bearing will be excessive due to the localized edge loading from the drive shaft. Frusto-conical web 114 is designed to produce a vibration behavior as shown by the solid line in FIG. 6. The design of web 114 and its interface with both circular section 100 and cylindrical section 116 provides the necessary compliancy to the system which elastically matches the shaft and the bearing which significantly reduces the edge loading. The edge loading is reduced due to the elastic matching of the shaft and the bearing allowing the bearing to flex when the shaft vibrates at its natural frequency.

While the above detailed description describes the preferred embodiment of the present invention, it should be understood that the present invention is susceptible to modification, variation and alteration without deviating from the scope and fair meaning of the subjoined claims.

What is claimed is:

1. A compressor assembly comprising:

an outer shell;

a compressor disposed in said shell;

a main bearing housing disposed within said shell;

a main bearing disposed within said main bearing housing;

a lower bearing housing disposed within said shell;

a drive member rotatably supported by said main bearing in said main bearing housing and said lower bearing housing; and a motor operatively attached to said drive member for rotating said drive member; wherein:

said drive member defines a first nodal point and a second nodal point during vibration of said drive member at a natural frequency of said drive member; and an elastic center of said main bearing coincides with said first nodal point of said drive member.

2. The compressor assembly according to claim 1, wherein said main bearing housing defines a circular section, a cylindrical section and a frusto-conical section disposed between said circular section and said cylindrical section, said main bearing being disposed within said cylindrical section.

3. The compressor assembly according to claim 2, wherein said cylindrical section defines a first end and a second end, said frusto-conical section being attached at a position adjacent said first end.

4. The compressor assembly according to claim 2, further comprising a plurality of towers disposed between said circular section and said shell.

5. The compressor assembly according to claim 2, wherein said cylindrical section pivots with respect to said frusto-conical section during said vibration of said drive member at said natural frequency of said drive member.

6. The compressor assembly according to claim 1, wherein said shell defines a suction pressure zone and a discharge pressure zone, said compressor being disposed within said suction pressure zone.

7. The compressor assembly according to claim 6, wherein said motor is disposed within said suction pressure zone.

8. A scroll machine comprising:

an outer shell;

a first scroll member disposed within said shell, said first scroll member having a first spiral wrap projecting outwardly from a first end plate;

a second scroll member disposed within said shell, said second scroll member having a second spiral wrap projecting outwardly from a second end plate, said second scroll wrap being interleaved with said first spiral wrap to define a plurality of moving chambers therebetween when said second scroll member orbits with respect to said first scroll member;

a main bearing housing disposed within said shell, said main bearing housing supporting said second scroll member;

a main bearing disposed within said main bearing housing;

a lower bearing housing disposed within said shell;

a drive member rotatably supported by said main bearing housing in said main bearing housing and said lower bearing housing, said drive member causing said second scroll member to orbit with respect to said first scroll member; and a motor operatively attached to said drive member for rotating said drive member; wherein:

said drive member defines a first nodal point and a second nodal point during vibration of said drive member at a natural frequency of said drive member; and an elastic center of said main bearing coincides with said first nodal point of said drive member.

9. The scroll machine according to claim 8, wherein said main bearing housing defines a circular section, a cylindrical section and a frustoconical section disposed between said circular section and said cylindrical section, said main bearing being disposed within said cylindrical section.

10. The scroll machine according to claim 9, wherein said cylindrical section defines a first end and a second end, said frusto-conical section being attached at a position adjacent said first end.

11. The scroll machine according to claim 9, further comprising a plurality of towers disposed between said circular section and said shell.

12. The scroll machine according to claim 9, wherein said cylindrical section pivots with respect to said frusto-conical section during said vibration of said drive member at said natural frequency of said drive member.

13. The scroll machine according to claim 8, wherein said shell defines a suction pressure zone and a discharge pressure zone, said compressor being disposed within said suction pressure zone.

14. The scroll machine according to claim 13, wherein said motor is disposed within said suction pressure zone.

15. A compressor assembly comprising:

an outer shell;

a compressor disposed in said shell;

a main bearing housing disposed within said shell, said main bearing housing defining a bore;

a main bearing secured within said bore of said main bearing housing;

a lower bearing housing disposed within said shell; and a drive member rotatably supported by said bore of said main bearing housing and said lower bearing housing, said drive member deflecting from a generally straight condition in alignment with said bore to a generally curved condition during rotation of said drive member; wherein:

said main bearing housing deflects such that said alignment between said bore and said drive member is maintained; and an elastic center of said main bearing coincides with a nodal point of said drive member during vibration of said drive member at a natural frequency of said drive member.

16. The compressor assembly according to claim 15, wherein an elastic center of said bore in said main bearing housing coincides with the nodal point of said drive member during said vibration of said drive member at said natural frequency of said drive member.

17. The compressor assembly according to claim 15, wherein said main bearing housing defines a circular section, a cylindrical section and a frusto-conical section disposed between said circular section and said cylindrical section, said bore being disposed within said cylindrical section.

18. The compressor assembly according to claim 17, wherein said cylindrical section defines a first end and a second end, said frusto-conical section being attached at a position adjacent said first end.

19. The compressor assembly according to claim 17, wherein said cylindrical section pivots with respect to said frusto-conical section to maintain said alignment between said bore and said drive member.

20. A scroll machine comprising:

an outer shell;

a first scroll member disposed within said shell, said first scroll member having a first spiral wrap projecting outwardly from a first end plate;

a second scroll member disposed within said shell, said second scroll member having a second spiral wrap projecting outwardly from a second end plate, said second scroll wrap being interleaved with said first spiral wrap to define a plurality of moving chambers therebetween when said second scroll member orbits with respect to said first scroll member;

a main bearing housing disposed in said shell, said main bearing housing supporting said second scroll member;

a main bearing disposed within said main bearing housing;

a lower bearing housing disposed in said shell;

a drive member rotatably supported by said main bearing in said main bearing housing and said lower bearing housing, said drive member causing said second scroll member to orbit with respect to said first scroll member; and a motor operatively attached to said drive member for rotating said drive member wherein:

said drive member defines a first nodal point and a second nodal point during vibration of said drive member at a natural frequency of said drive member; and an elastic center of said main bearing coincides with said first nodal point of said drive member.

21. The scroll machine according to claim 20 wherein said main bearing housing defines a circular section, a cylindrical section and a frusto conical section disposed between said circular section and said cylindrical section, said main bearing being disposed within said cylindrical section.

22. The scroll machine according to claim 21, wherein said cylindrical section defines a first end and a second end, said frusto-conical section being attached at a position adjacent said first end.

23. The scroll machine according to claim 21 further comprising a plurality of towers disposed between said circular section and said shell.

24. The scroll machine according to claim 21 wherein said cylindrical section pivots with respect to said frusto-conical section during said vibration mode of said drive member at said natural frequency of said drive member.

* * * * *